US005903108A

United States Patent [19]

Mougin et al.

[11] Patent Number: 5,903,108

[45] Date of Patent: May 11, 1999

[54] FLAT DISPLAY SCREEN ANODE WITH PROTECTION RING FOR COLLECTING SECONDARY ELECTRONS

[75] Inventors: Stephane Mougin, Castelnau le Lez; Francis Courreges, Montpellier; Bernard Bancal, Luynes; Lionel Riviere-Cazaux, Montpellier, all of France

[73] Assignee: Pixtech S.A., Rousset, France

[21] Appl. No.: 08/841,857

[22] Filed: May 5, 1997

[30] Foreign Application Priority Data

May 6, 1996 [FR] France ..... 96/05931

[51] Int. Cl.[6] ..... H01J 29/08

[52] U.S. Cl. ..... 315/169.1; 345/74; 313/496

[58] Field of Search ..... 313/496, 497, 313/422; 315/169.1, 169.3; 345/74, 75

[56] References Cited

U.S. PATENT DOCUMENTS

| | | | |
|---|---|---|---|
| 5,508,584 | 4/1996 | Tsai et al. | 313/497 |
| 5,543,691 | 8/1996 | Palevsky et al. | 313/309 X |
| 5,561,345 | 10/1996 | Kuo | 313/495 |
| 5,614,781 | 3/1997 | Spindt et al. | 313/495 X |
| 5,670,296 | 9/1997 | Tsai | 445/52 X |

*Primary Examiner*—Robert Pascal
*Assistant Examiner*—Justin P. Bettendorf
*Attorney, Agent, or Firm*—Arthur L. Plevy

[57] ABSTRACT

The present invention relates to a flat display screen anode of the type including an active area having phosphor elements, the active area being surrounded with at least one track in a material having a secondary emission coefficient lower than or equal to one.

13 Claims, 3 Drawing Sheets

FLAT DISPLAY SCREEN ANODE WITH PROTECTION RING FOR COLLECTING SECONDARY ELECTRONS

BACKGROUND OF THE INVENTION

1. Field of the Invention

The present invention relates to flat display screens, and more particularly to so-called cathodoluminescence screens, the anode of which carries luminescent elements separated from one another by insulating areas, and likely to be excited by electron bombarding. This electron bombarding requires the biasing of the luminescent elements and can come from microtips, from layers with a low extraction potential or from a thermo-ionic source.

2. Discussion of the Related Art

To simplify the present description, only microtip screens will be considered hereafter, but it should be noted that the present invention relates generally to the various above-mentioned types of screens and the like.

FIG. 1 shows the structure of a flat color microtip display screen.

Such a microtip screen is essentially comprised of a cathode 1 with microtips 2 and of a grid 3 provided with holes 4 corresponding to the locations of microtips 2. Cathode 1 is placed facing a cathodoluminescent anode 5, a glass substrate 6 of which constitutes the screen surface.

The operating principle and a specific embodiment of a microtip screen are described, in particular, in U.S. Pat. No. 4,949,116 of the Commissariat à l'Energie Atomique.

Cathode 1 is organized in columns and is comprised, on a glass substrate 10, of cathode conductors organized in meshes from a conductive layer. The microtips 2 are implemented on a resistive layer 11 deposited on the cathode conductors and are arranged within the meshes defined by the cathode conductors. FIG. 1 partially shows the inside of a mesh and the cathode conductors do not appear on the drawing. Cathode 1 is associated with grid 3 organized in lines. The intersection of a line of grid 3 and of a column of cathode 1 defines a pixel.

This device uses the electric field which is created between cathode 1 and grid 3 to extract electrons from microtips 2. These electrons are then attracted by phosphor elements 7 of anode 5 if the latter are adequately biased. In the case of a color screen, anode 5 is provided with alternate bands of phosphor elements 7*r*, 7*g*, 7*b*, each corresponding to a color (Red, Green, Blue). The bands are parallel to the columns of the cathode and are separated from one another by an insulator 8, generally silicon oxide ($SiO_2$). The phosphor elements 7 are deposited on electrodes 9, comprised of corresponding bands of a transparent conductive layer such as indium and tin oxide (ITO). The sets of red, green, blue bands are alternately biased with respect to cathode 1, so that electrons extracted from the microtips 2 of a pixel of the cathode/grid are alternately directed towards the phosphor elements 7 facing each of the colors.

The control for selecting the phosphor 7 (phosphor 7*g* in FIG. 1) which is to be bombarded by the electrons from the microtips of cathode 1 imposes to control, selectively, the biasing of phosphor elements 7 of anode 5, color per color.

Generally, the rows of grid 3 are sequentially biased at a potential of around 80 volts, while the bands of phosphor elements (for example 7*g* in FIG. 1) to be excited are biased under a voltage of around 400 volts via the ITO band on which the phosphor elements are deposited. The ITO bands, carrying the other bands of phosphor elements (for example, 7*r* and 7*b* in FIG. 1), are at a low or zero potential. The columns of cathode 1 are brought to respective potentials between a maximum emission potential and a no emission potential (for example, respectively 0 and 30 volts). The brightness of a color component of each of the pixels in a line is thus determined.

The choice of the values of the biasing potentials is linked with the features of the phosphor elements and of microtips 2. Conventionally, below a voltage difference of 50 volts between the cathode and the grid, there is no electronic emission, and the maximum emission used corresponds to a voltage difference of 80 volts.

A space 12 between substrates 6 and 10 is generally defined by means of spacers (not shown) regularly distributed on the entire surface of the screen between grid 3 and anode 5. Substrates 6 and 10 are assembled together by means of a peripheral sealing, for example, by means of a cord of fusible glass constituting, once hardened, a rigid peripheral joint.

In the case of a color screen, the tracks for connecting bands 9 by sets of bands carrying phosphor elements of a same color require the forming, on substrate 6, of a piling of insulating and conductive layers, since three sets of alternate bands have to be interconnected.

In the case of a monochrome screen, the anode of which is comprised of a plane of phosphor elements of a same color, only one connection track is needed and this track can be directly deposited on substrate 6.

A disadvantage of conventional screens is that they have a low lifetime, that is, after a relatively short operating time (of around a hundred hours), destructive phenomena due to the forming of sparks at the screen circumference occur.

The origin of this phenomenon is not well understood. It was generally thought to be due to the small space between electrodes (of around 0.2 mm) with respect to the high voltage difference between the anode and the cathode. In order to overcome, among others, this phenomenon, it had been provided to increase the distance between electrodes for a given anode/cathode voltage. However, this solution results in the occurrence of other problems (spacers, focusing . . . ) and only delays the occurrence of destructive phenomena at the screen circumference.

SUMMARY OF THE INVENTION

The present invention aims at providing a new solution to the above-mentioned problems of sparks appearing at the circumference of the screen.

To achieve this object, the present invention provides a flat display screen anode of the type including an active area having phosphor elements, wherein said active area is surrounded by at least one track for collecting secondary electrons likely to be emitted back by the active area following an electronic bombarding thereof, at least a great portion of said track being separated from the periphery of the active area by a spacing in an insulating material.

According to an embodiment of the invention, the width of the track is greater than the distance likely to be covered by secondary electrons emitted back by the insulating material.

According to an embodiment of the invention, the width of the track is greater than 50 $\mu$m.

According to an embodiment of the invention, the width of the insulating spacing is less than the distance likely to be covered by secondary electrons emitted back by the material of which it is made.

According to an embodiment of the invention, the track is brought to a potential which is substantially lower than the biasing potential of the active area.

According to an embodiment of the invention, the anode includes at least two concentric tracks surrounding the active area, a first track proximal to the active area being brought to an intermediate potential between the potential of this active area and a potential to which is brought a second track which is distal with respect to the active area.

According to an embodiment of the invention, the track(s) are open to allow a passage of a track for biasing the active area.

According to an embodiment of the invention, the track is spiral-shaped between the active area and a connection terminal at a potential lower than that of the active area.

According to an embodiment of the invention, resistors are interposed in each section of the spiral.

According to an embodiment of the invention, the track(s) are in low resistivity material.

According to an embodiment of the invention, the track(s) are in a material having a secondary emission coefficient lower than or equal to unity.

The foregoing objects, features and advantages of the present invention will be discussed in detail in the following non-limiting description of specific embodiments of the present invention, in relation with the accompanying drawings.

DETAILED DESCRIPTION

For clarity, the same elements have been referred to by the same reference numbers in the different drawings. For the same reasons, the representations of the drawings are not to scale.

The origin of the present invention is an interpretation of the phenomenon which generates the above-mentioned problem in conventional screens.

The inventors consider that this problem is due, in particular, to a secondary emission phenomenon occurring at the anode circumference.

Figure 1:
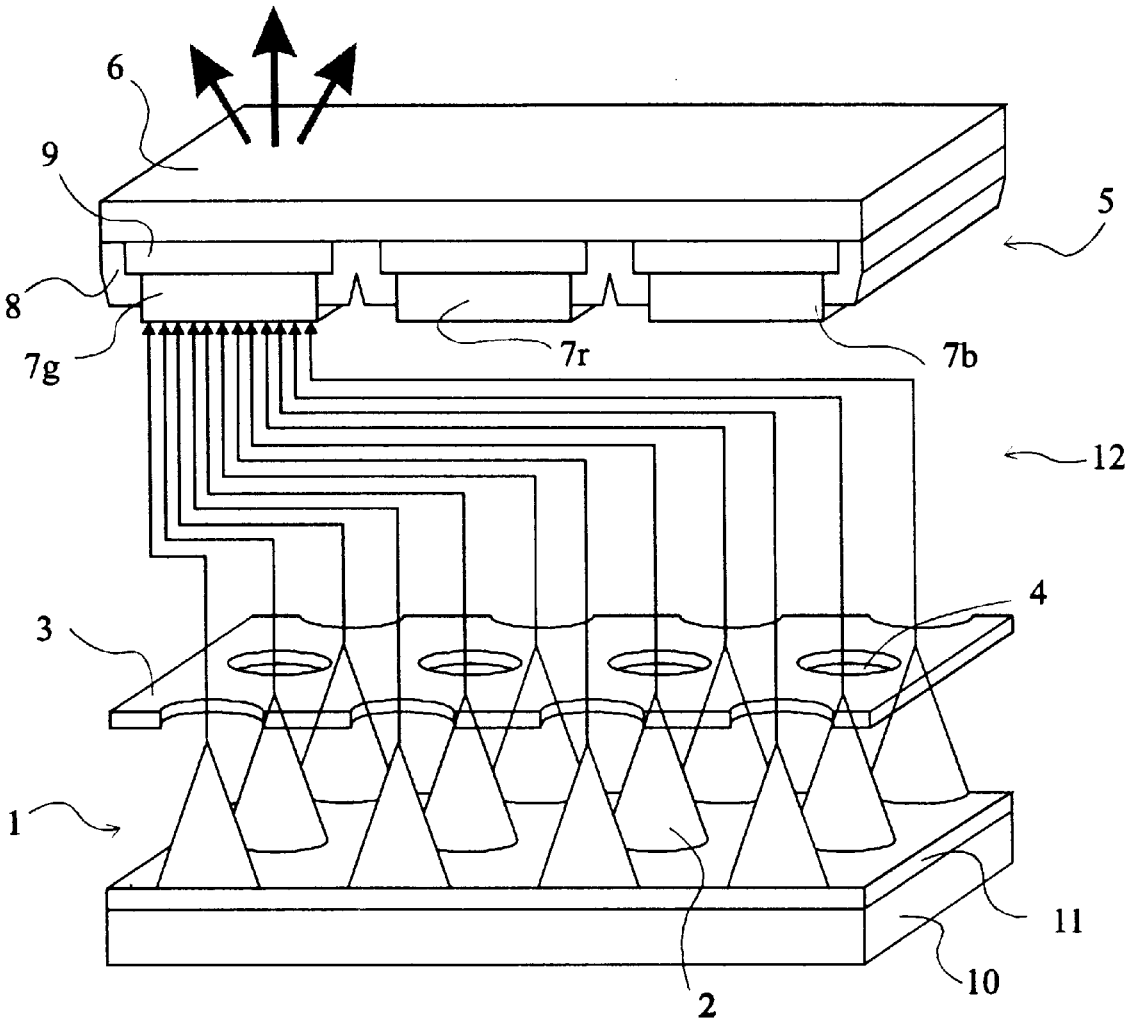
Fig 1 PRIOR ART
FIG. 1, previously described, schematically shows the overall structure of a conventional microtip screen.
Figure 2:
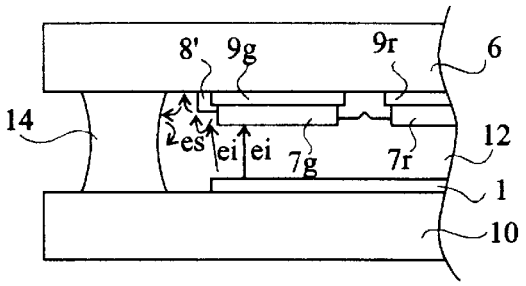
Fig 2 PRIOR ART
FIG. 2 shows, schematically and in cross-sectional view, the edge of a conventional flat display screen.

FIG. 2 shows, schematically and in cross-sectional view, the edge of a flat display screen. For clarity, the details constitutive of cathode 1 and of grid 3 have not been shown.

As indicated previously, once the screen is finished, the internal spacing 12 is surrounded with a glass joint 14 ensuring the sealing of substrates 6 and 10 respectively carrying the anode and the cathode of the screen. For a color screen, joint 14 has to be placed away from the edge of the active area of the anode carrying the phosphor elements to enable the interconnection of the bands by sets of a same color. For clarity, the piling of the conductive and insulating layers has not been shown in FIG. 2. Only a peripheral insulating band 8' has been shown. This band 8' can either extend up to joint 14, or leave substrate 6 accessible in some parts of the circumference of the screen, as shown in FIG. 2.

When an ITO band located at the circumference of the screen (for example, band 9*g* in FIG. 2) is biased at 400 volts, "primary" electrons $e_i$ emitted by the microtips (not shown) of cathode 1 arrive onto the phosphors 7*g*. "Secondary" electrons $e_s$ are emitted back by the phosphors 7*g*. Further, a number of primary electrons arrive on the edge of insulating layer 8' or directly on substrate 6 in the regions eventually devoid of layer 8'. Here, again, there is secondary emission.

Any material has a secondary emission coefficient, called $\delta$, which represents the mean number of secondary electrons which are emitted back for an incident electron arriving on this material. The prevailing energy of the statistic distribution of the secondary electrons is around 30 to 50 eV, whatever the energy of the incident electrons.

The secondary emission coefficient of a material varies according to the energy of the electrons which touch its surface. Generally, this coefficient starts by increasing until it reaches a maximum level $\delta_{max}$, then decreases to an asymptote value. In the case of microtip screens, the energy of the primary electrons is linked to the biasing potential of the anode and is, for example, around 400 eV.

When secondary emission coefficient $\delta$ is higher than 1, it means that the surface of the material emits back more electrons than it has received and tends to charge positively. Conversely, when secondary emission coefficient $\delta$ is lower than 1, electrons are accumulated.

The fact that microtip screens are implemented by using technologies derived from those used in the making of integrated circuits has resulted in the use of silicon oxide to implement insulating bands 8'. Indeed, silicon oxide is a usual material and its use is well controlled. Unfortunately, silicon oxide has a particularly high secondary emission coefficient ($\delta_{max}$ is around 3 for an energy of around 400 eV).

Similarly, the glass constituting substrate 6 and joint 14 has a secondary emission coefficient which is also very high ($\delta_{max}$ is around 4 for an energy of around 400 eV).

The consequence of this secondary emission phenomenon is the following.

Initially, track 8', substrate 6 and joint 14 are at a zero potential. The primary electrons which arrive on the edge of track 8' (or on substrate 6) at the edge of track 9*g* when it is biased cause, by the emission of secondary electrons, a positive charge at the surface of the silicon oxide of layer 8' (or at the surface of substrate 6). As the screen operates, this positive charge area develops, since the primary electrons are more and more attracted by the surface of band 8' or of substrate 6 as its positive charge increases. Further, the emission of a secondary electron generally leads in turn to a new emission of secondary electrons. The positive charge area propagates towards joint 14, and then to the surface of glass joint 14 and thus comes progressively closer to the cathode. When the positive charge area becomes close enough to the cathode, a spark phenomenon occurs due to the voltage difference with the cathode.

It can now be understood why spacing apart the substrates from one another only delays the occurrence of electric arcs at the screen circumference.

Based on this analysis, the present invention provides to trap secondary electrons to prevent the propagation of the secondary emission phenomenon up to the sealing joint.

A feature of the present invention is to place, between the active area bearing the phosphor elements of the anode and the sealing joint, a track for collecting the secondary electrodes. This collection track is, according to the invention, either in a conductive material biased at a determined potential, or in a material having a secondary emission coefficient lower or equal to unity, which can preferably be biased.

According to the invention, at least a great portion of the collection track is separated from the periphery of the active area by a spacing in an insulating material.

If the track is biased, its biasing potential is chosen to not attract electrons emitted by the cathode.

The choice of the material depends, in particular, on the number and the shape of the collection tracks, as will be seen hereafter in connection with different embodiments of the invention. For a material having a low secondary emission coefficient δ, one will choose a material having a secondary emission coefficient δ which is lower than unity at least in the energy range of the primary electrons emitted by the microtips. For a conductive material, a low resistivity material will be chosen if its secondary emission coefficient δ is greater than unity.

Figure 3:
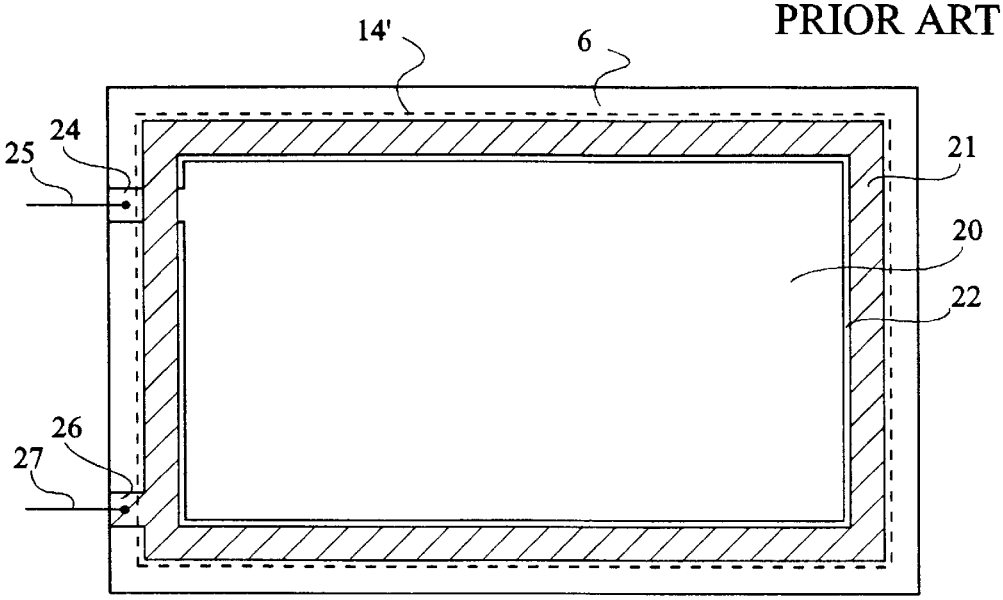
FIG. 3 shows a first embodiment of a cathodoluminescence flat display, screen anode according to the present invention.
Figure 4:
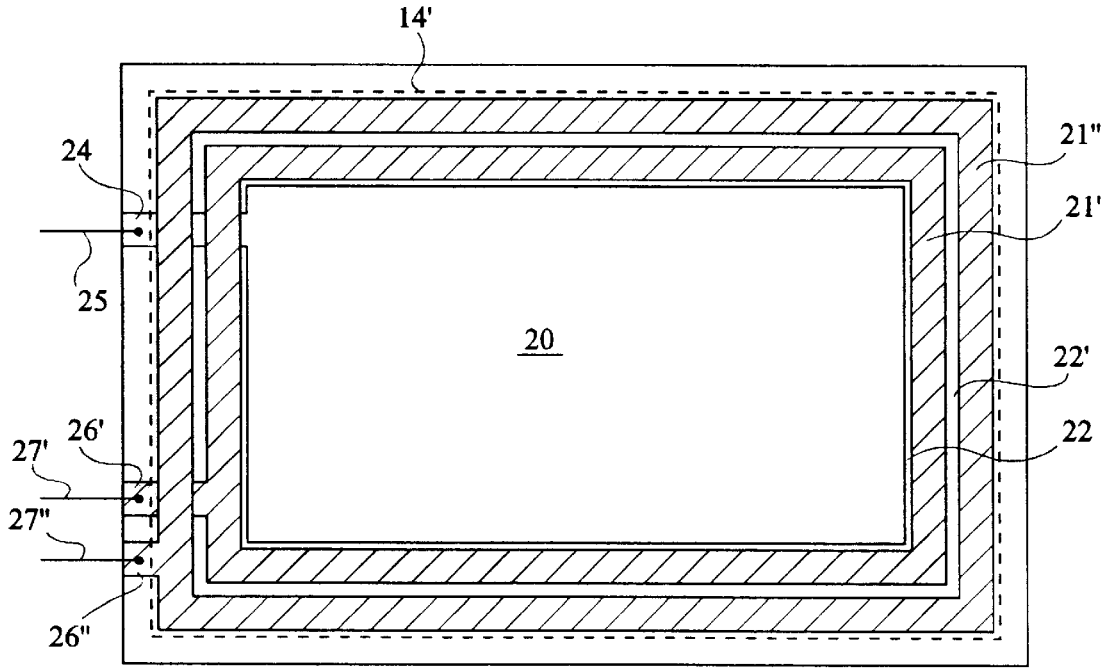
FIG. 4 shows a second embodiment of a cathodoluminescence flat display screen anode according to the present invention.
Figure 5:
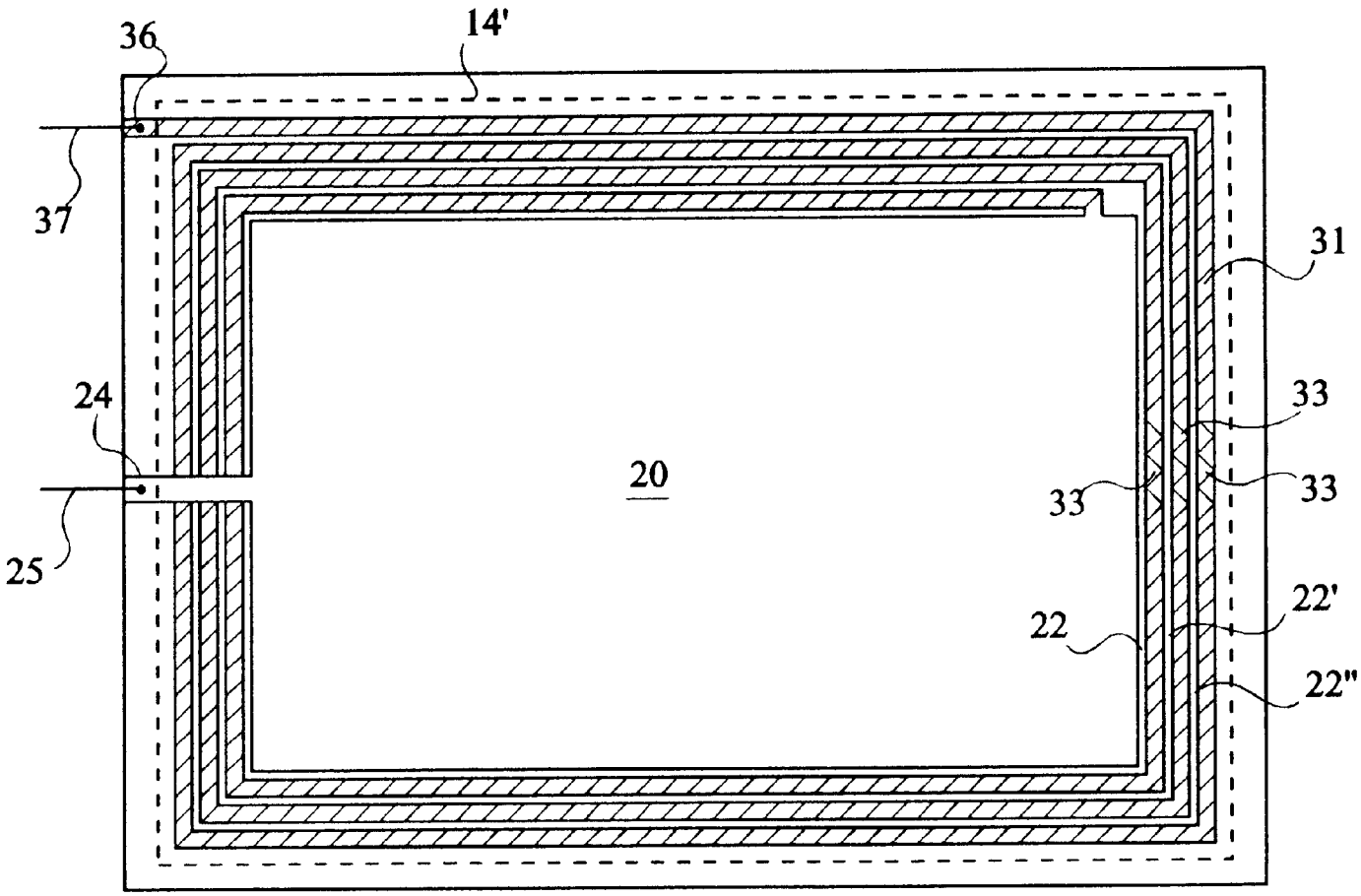
FIG. 5 shows a third embodiment of a cathodoluminescence flat display screen anode according to the present invention.

These embodiments will now be described in relation with FIGS. 3 to 5. To simplify the drawings, FIGS. 3 to 5 refer to anodes of monochrome screens comprised of a plane 20 of phosphor elements of a same color supported by a corresponding ITO plane (not shown on the drawings). It should however be noted that the different embodiments which will be described hereafter also apply to the case of a color screen, the anode of which is comprised of several sets of alternate parallel bands of phosphor elements of a same color. In FIGS. 3 to 5, the position of the inner limit of the sealing joint (14, FIG. 2) is symbolized by a frame in dotted lines 14'.

FIG. 3 shows a first embodiment of a flat screen anode according to the present invention.

According to this embodiment, the active area 20 is surrounded by a single track 21 for collecting the secondary electrons.

Preferably, track 21 is a ring around active area 20 and is biased at a potential substantially lower than the biasing potential of the active area in order to not disturb the operation of the screen by attracting electrons from the cathode (not shown).

Ring 21 should not be in contact with active area 20. Thus, ring 21 and active area 20 are separated by an insulating material 22, for example, the glass of substrate 6 on which the anode is formed or a silicon oxide band transferred on substrate 6.

When not biased, ring 21, since its secondary emission coefficient is lower than 1, charges negatively when it receives secondary electrons emitted back by the surface of material 22 and, once charged, focuses the electrons towards active area 20. However, this negative charge is difficult to control. In particular, it is difficult to determine the width of insulating spacing 22 which enables to avoid the occurrence of electric arcs between active area 20 and track 21.

When biased, the potential of ring 21 is, for example, zero or close to zero (preferably slightly negative).

The width of ring 21 is chosen to be greater than the mean distance likely to be covered by secondary electrons emitted back by insulating material 22 and which is, as previously, likely to receive primary electrons from the microtips. Typically, with an energy of around 30 eV, a secondary electron covers a distance of around 50 μm. Thus, the width of ring 21 is, preferably, substantially greater than 50 μm.

Insulating spacing 22 must be sufficient to avoid that an electric arc develops between active area 20 and collection ring 21. It will however be rendered as narrow as possible to avoid development of a positive charge area in this spacing. Ideally, and if the biasing potentials allow it, the width of spacing 22 is less than the mean distance likely to be covered by secondary electrons emitted by the surface of this spacing, that is, preferably lower than 50 μm. This guarantees that all secondary electrons emitted back by insulating material 22 are collected by material 21.

At least if it does not have a low resistivity, the material of track 21 preferably has a secondary emission coefficient $\delta_{max}$ which is lower than 1. This guarantees the absence of secondary emission independently from the energy of the primary electrons, that is, independently from the biasing values of the anode and the cathode. It will be noted that, in the first embodiment, the material of track 21 may be insulated, if necessary, if it is not desired to bias it.

An advantage of the present invention is that it avoids any phenomenon of propagation of secondary emission up to the sealing joint 14' between the anode and cathode plates. Further, the biasing of ring 21 enables to evacuate the corresponding charges.

In FIG. 3, ring 21 is continuous and thus covers, with the interposition of an insulator (not shown), a track 24 for biasing active area 20. This track 24 extends beyond joint 14' and is meant to be connected, via a connector 25, to screen control circuitry (not shown). Similarly, ring 21 is biased by means of a conductive track 26, extending beyond joint 14' and meant to receive a connector 27 for connection to the control circuitry.

An opening may however be left in the ring, which allows the passage without contact of track 24. This has the advantage of allowing the use of the same material (for example ITO) for area 20, track 24 and ring 21, which may then be etched in a same process step.

FIG. 4 shows a second embodiment of a flat screen anode according to the present invention.

According to this second embodiment, active area 20 of the anode is surrounded with two concentric rings for collecting secondary electrons. A first ring 21' is separated from area 20 by a spacing in an insulating material 22. A second ring 21" surrounds ring 21' while being separated from the latter by a second spacing in an insulating material 22' (for example, the glass of substrate 6 or silicon oxide deposited thereon). Here the material constituting rings 21' and 21" is chosen so that it can be biased (and having a δ smaller than 1 if it does not have a low resistivity).

As previously, the width of rings 21' and 21" is chosen to be greater than the mean distance that secondary electrons emitted back by the insulating materials, respectively 22 and 22', are likely to cover.

Active area 20 is biased by means of a track 24 and a connector 25. Rings 21' and 21" are biased by means of tracks, respectively 26' and 26", and of connectors, respectively 27' and 27".

According to the present invention, rings 21' and 21" are biased at different potentials, ring 21' being, preferably, at an intermediate potential between the potential of active area 20 and the potential of external ring 21". As a particular example, ring 21' is at a potential of 200 volts and ring 21" is at a zero potential.

An advantage of this second embodiment is that by making the potential decrease more progressively from the active area to the edge of the screen, it avoids edge effects by spreading the electric field lines.

Another advantage of this second embodiment is that it enables to reduce the width of spacings 22 and 22' between active area 20 and ring 21' and between ring 21' and ring 21". Indeed, the limit distance for creating an electric arc is lower, since the voltage difference between area 20 and ring 21' and between ring 21' and ring 21" is reduced. This minimizes the development of the positive charge area in spacing 22 by facilitating the respect of the width compromise of spacing 22, linked with the need to prevent the formation of an electric arc between area 20 and ring 21' and the desire to have a width which is less than the distance covered by secondary electrons.

FIG. 5 shows a third embodiment of a flat screen anode according to the present invention.

According to this embodiment, the collection of secondary electrons is performed by means of a track 31 shaped as a spiral which connects one edge of active area 20 to a connection terminal 36, by means of a conductor 27, at a zero or near zero potential. Here, track 31 is chosen so that it has a secondary emission coefficient smaller than unity.

Spacings in an insulating material 22, 22' and 22" are provided between active area 20 and the first spiral winding and between each spiral winding of track 31.

As previously, the width of the windings of track 31 will be sufficient to avoid that secondary electrons skip the windings and propagate from insulating spacing 22 to insulating spacing 22' or 22" to reach the edge of the screen.

In this third embodiment, the width of the windings is also conditioned by the desired resistivity to obtain a progressive decrease in the potential from the active area (at 400 volts) to terminal 36 (for example, at 0 volts).

According to the present invention, the width of track 31 is chosen such that track 31 has a sufficient resistivity to minimize the current flow therethrough.

As an alternative and depending on the resistivity of the material selected to constitute track 31, it can be provided, according to the present invention, to incorporate resistors 33, for example, obtained by serigraphy, in each spiral winding defined by track 31.

The biasing of active area 20 is, as previously, obtained by means of a track 24 for receiving a connector 25 connected to the screen control circuitry.

An advantage of the third embodiment shown in FIG. 5 is that it creates a progressive and controlled decrease in the potential between active area 20 and joint 14'.

Another advantage of this third embodiment is that it does not require any intermediate voltage source, while minimizing edge effects.

The material constitutive of the secondary electron collection rings 21, 21', 21" or 31 according to one of the previous embodiments is, for example, ITO (low resistivity material).

The secondary electron collection ring(s) may also be implemented in chromium oxide ($Cr_2O_3$) which has a maximum secondary emission coefficient $\delta_{max}$ of around 0.95. In this case, the eventual biasing of the collection track(s) is obtained via a conductive layer having the same pattern (for example, in ITO), on which a chromium oxide layer is deposited.

In the case where chromium oxide is chosen to implement track 31 of the third embodiment shown in FIG. 5, the addition of resistors 33 will generally be superfluous, since chromium oxide is a material having a higher resistivity than ITO. Further, the use of chromium oxide enables to implement, according to this third embodiment, wider windings, which improves the absence of secondary electron propagation.

It will be noted that, if the material chosen for tracks 21', 21" and 31 does not have a $\delta$ coefficient smaller than 1, its resistivity should be sufficiently small to evacuate the charges through its biasing and thus avoid a secondary electron reemission.

The implementation of the present invention according to any of the embodiments described hereabove can be performed by conventional deposition and track definition means for the selected material. For example, a cathode sputtering or an evaporation could be used. It should be noted that the width of the tracks also enables to use serigraphy.

Of course, the present invention is likely to have various alterations, modifications, and improvements which will readily occur to those skilled in the art. In particular, the selection of the biasing potential(s) of the secondary electron collection rings depends on the respective potentials of the anode and the cathode of the screen.

Further, other materials than those indicated as an example can be used to implement the collection ring(s), and the dimension given as an example can be modified according to the application.

Moreover, although the examples described refer to a monochrome screen, the present invention also applies to a color screen. In this case, the secondary electron collection ring(s) are deposited above the piling enabling the interconnection of the bands of phosphor elements.

What is claimed is:

1. A flat display screen anode of the type including an active area having phosphor elements, wherein said active area (20) is surrounded by at least one track (21, 21', 31) for collecting secondary electrons likely to be emitted back by the active area following an electronic bombarding thereof, at least a large portion of said track being separated from the periphery of the active area by a spacing in an insulating material.

2. The anode according to claim 1, wherein the width of the track (21, 21', 21", 31) is greater than the distance likely to be covered by secondary electrons emitted back by the insulating material (22, 22', 22").

3. The anode according to claim 2, wherein the width of the track (21, 21', 21", 31) is greater than 50 $\mu$m.

4. The anode according to any of claims 1 to 3, wherein the width of the insulating spacing (22, 22', 22") is less than the distance likely to be covered by secondary electrons emitted back by the material of which it is made.

5. The anode according to claim 1, wherein the track (21, 21', 31) is brought to a potential which is substantially lower than the biasing potential of the active area (20).

6. The anode according to claim 1, including at least two concentric tracks (21', 21") surrounding the active area (20), a first track (21') proximal to the active area (20) being brought to an intermediate potential between the potential of this active area (20) and a potential to which is brought a second track (21") which is distal with respect to the active area (20).

7. The anode according to claim 1, wherein the track(s) are open to allow a passage of a track (24) for biasing the active area (20).

8. An anode according to claim 7, wherein resistors (33) are interposed in each section of the spiral (31).

9. An anode according to claim 1, wherein the track (31) is spiral-shaped between the active area (20) and a connection terminal (36) at a potential lower than that of the active area (20).

10. The anode according to claim 1, wherein the track(s) (21, 21', 21", 31) are in low resistivity material.

11. The anode according to claim 1, wherein the track(s) (21, 21', 21", 31) are in a material having a secondary emission coefficient (6) lower than or equal to unity.

12. A flat display screen anode comprising:

an active area;

a plurality of phosphor elements, each of said plurality of phosphor elements being positioned within said active area; and, at least one track surrounding said active area and for collecting secondary electrons emitted by the active area following an electronic bombarding thereof;

wherein at least a great portion of said at least one track is separated from the periphery of the active area by an insulating material defining a spacing.

13. The anode of claim 12, wherein said at least one track does not extend in said active area.

* * * * *